United States Patent [19]

Sieberth

[11] Patent Number: 4,862,871

[45] Date of Patent: Sep. 5, 1989

[54] COMBUSTION OF LOGS AND DEVICES THEREFOR

[76] Inventor: James F. Sieberth, 1656 W. Fairview Dr., Baton Rouge, La. 70816

[21] Appl. No.: 180,042

[22] Filed: Apr. 11, 1988

[51] Int. Cl.[4] ..... F24B 13/00

[52] U.S. Cl. ..... 126/298; 126/540; 206/821; 211/60.1

[58] Field of Search ..... 126/153, 152 R, 152 B, 126/298, 540, 541; 211/13, 49.1, 60.1, 70.4; 206/821; 44/540; D23/397, 398, 407; D25/67; 138/106

[56] References Cited

U.S. PATENT DOCUMENTS

| | | | |
|---|---|---|---|
| D. 247,344 | 2/1978 | Smith | D23/398 |
| 1,921,228 | 8/1933 | Hetherington | 206/821 |
| 2,985,165 | 5/1961 | Peterson et al. | 126/165 |
| 4,360,001 | 11/1982 | Thompson | 126/298 |
| 4,515,147 | 5/1985 | Van Grouw et al. | 126/163 R |

FOREIGN PATENT DOCUMENTS

| | | | |
|---|---|---|---|
| 54-35406 | 3/1979 | Japan | 206/821 |

*Primary Examiner*—Albert J. Makay
*Assistant Examiner*—Noah Kamen
*Attorney, Agent, or Firm*—John F. Sieberth

[57] ABSTRACT

Combustion of horizontally-stacked fireplace logs is expedited and facilitated by maintaining the adjacent logs in a spaced-apart relationship, at least until proper combustion of the individual logs has been initiated. This enables the surfaces of the individual logs to rapidly reach combustion temperatures upon exposure to open flames from paper or other burning tinder or exposure to an underlying bed of glowing embers. The spacing of the logs can be readily accomplished by use of spacer devices. Preferred devices are members having a generally Y-shaped configuration in vertical cross-section so that the member has (i) a trunk portion adapted to be interposed in an upright position between two adjacent laterally positioned logs to provide spacing therebetween, and (ii) a pair of upwardly and outwardly extending arms forming an upper surface adapted to support or cradle another such log above, between and spaced from those two laterally positioned logs.

20 Claims, 2 Drawing Sheets

COMBUSTION OF LOGS AND DEVICES THEREFOR

TECHNICAL FIELD

This invention relates to improving the combustion of logs in fireplaces and like installations. More particularly, it relates to improving the initiation of combustion of the logs used as firewood in home fireplaces and to devices especially adapted to achieve such improved combustion initiation.

BACKGROUND

It is common practice to form a stack of fireplace logs on top of paper and other tinder materials. Unfortunately this frequently entails a long delay between the time the stack of logs has been formed and the time proper ignition of the logs has occurred. Such delays may be encountered even where the logs are stacked on top of glowing embers. In some cases flammable liquids have been applied to the logs to accelerate ignition. However this practice is undesirable as it can make the operation hazardous to both life and property. A welcome contribution to the art would be a way of accelerating such ignition without rendering the operation hazardous. This invention is believed to accomplish this objective most effectively and expeditiously.

SUMMARY OF THE INVENTION

Pursuant to this invention, combustion of horizontally-disposed fireplace logs is expedited and facilitated by maintaining the adjacent logs in a spaced-apart relationship, at least until proper combustion of the individual logs has been initiated. This enables the surfaces of the individual logs to rapidly reach combustion temperatures upon exposure to open flames from paper or other burning tinder or exposure to an underlying bed of glowing embers. The spacing of the logs can be readily accomplished by use of spacer devices provided in accordance with another embodiment of this invention.

These devices are members having a generally Y-shaped configuration in vertical cross-section so that the member has (i) a trunk portion adapted to be interposed in an upright position between two adjacent laterally positioned logs to provide spacing therebetween, and (ii) a pair of upwardly and outwardly extending arms forming an upper surface adapted to support or cradle another such log above, between and spaced from those two laterally positioned logs. One such device can be placed at any position intermediate the ends of the stack of three logs to provide a sufficient amount of spacing to facilitate ignition of the logs. However for best results, two or more such devices are employed so that a suitable amount of spacing is provided between the adjacent logs along their entire lengths.

In one embodiment of this invention the devices described above are fabricated of metal, ceramics or other fireproof material so that they are not consumed in the fire but instead may be recovered from the ashes for reuse. In still another embodiment the devices are fabricated from a material that burns very slowly so that the desired spacing is maintained between the adjacent logs until such time as combustion of the logs has been fully initiated to the desired extent and thereafter the devices themselves are consumed in the flames.

These and other features and embodiments of this invention will become still further apparent from a consideration of the ensuing description, the appended claims and the accompanying drawings.

THE DRAWINGS

DESCRIPTION OF PREFERRED EMBODIMENTS

Figure 1:
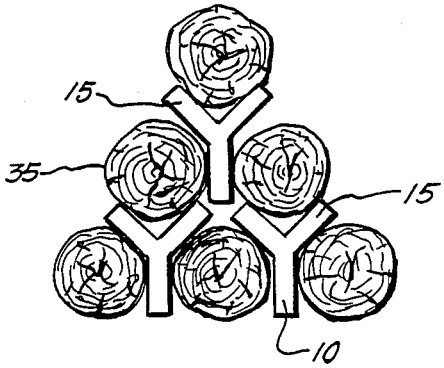
FIG. 1 is an end view of a stack of six logs spaced apart pursuant to this invention.

Referring to the Figures in which like numerals represent like features or elements among the several views, the devices of this invention are composed of an upright trunk portion 10 and a pair of upwardly and outwardly extending arm portions 15,15. As indicated by FIGS. 3 through 8, the devices have a generally Y-shaped configuration, the shape of which may be varied to a considerable extent. While the lengths may be different from each other, preferably arm portions 15,15 and trunk portion 10 are of substantially equal length. Most preferably arm portions 15,15 and trunk portion 10 are disposed relative to each other such that their respective longitudinal axes radiate from the center of the Y-shaped configuration at essentially 120 degree angles. It is also preferred that trunk portion 10 and each of arms 15,15 have essentially the same configuration (note FIGS. 3 and 7) so that the Y-shaped configuration is substantially symmetrical in all radial directions around its center. This enables the devices to used without concern for which part is the trunk of the "Y", since the trunk portion and the arm portions are interchangeable with each other.

Figure 3:
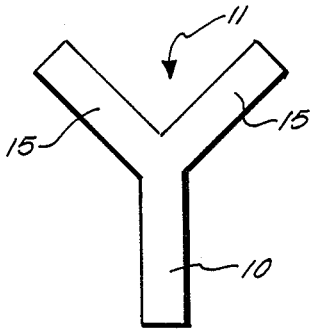
FIGS. 3 through 8 are end views (front or rear) of devices of this invention, and serve to illustrate some of the various configurations in which they may be provided.
Figure 4:
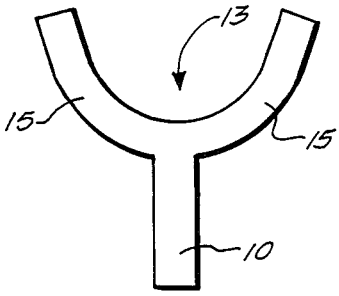
Figure 5:
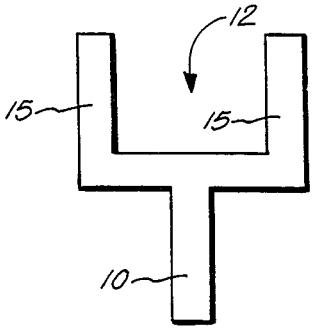
Figure 6:
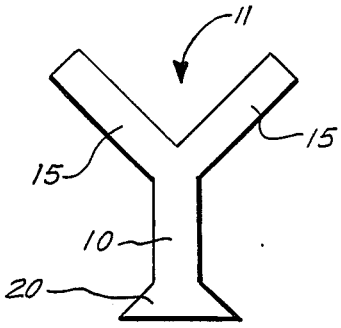

The upwardly facing surface between arms 15,15 may also be of various configurations. In FIGS. 3 and 6 it is in the form of a V-shaped trough 11. In FIG. 5 it is in the form of a rectangular trough 12. And in FIGS. 4, 7 and 8 it is in the form of a concave trough 13.

Figure 7:
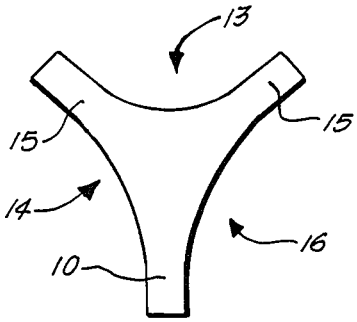

A device of preferred configuration illustrated by FIG. 7 involves a concave upper surface forming concave trough 13, and each of the pair of downwardly and outwardly facing concave surfaces forming concave recesses 14,16 defined respectively (a) by the lower portion of one arm 15 and the side of trunk portion 10 proximate thereto and (b) by the lower portion of the other arm 15 and the side of trunk portion 10 proximate thereto. This construction enhances the structural strength of the device about its center, and each of the concave surfaces and troughs is adapted to accommodate the exterior of a log when a log is positioned immediately adjacent thereto.

Figure 8:
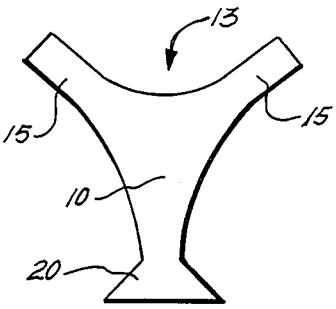
Figure 14:
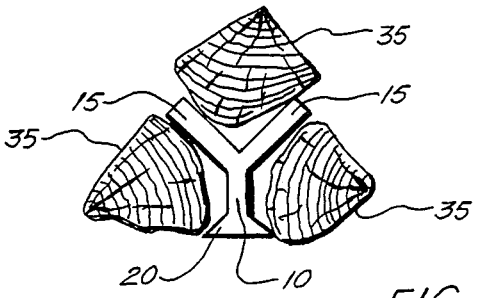
FIG. 14 is an end view of a stack of three split logs spaced apart pursuant to this invention.

As illustrated by FIGS. 6, 8 and 14, the lower part of trunk 10 may be provided on each side with a foot portion 20 serving as a lateral extension adapted to fit under a portion of a log when a log is positioned immediately adjacent to the sides of the trunk.

FIGS. 10 through 13 show that the devices such as depicted in FIGS. 3 through 8 may either be uniform in thickness (FIG. 10) or of varying thickness (FIGS. 11 through 13) from top to bottom. It will be appreciated that the side views depicted in FIGS. 5 through 8 do not show foot portion 20 of FIGS. 6 and 8, the position of which in side view nevertheless can be readily appreciated and visualized.

Figure 9:
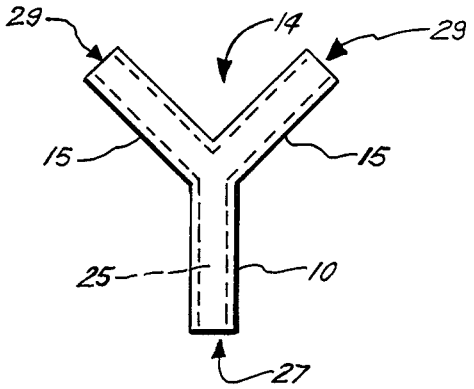
FIG. 9 is an end view (front or rear), partly in phantom, of a device of this invention having a hollow interior.
Figure 10:
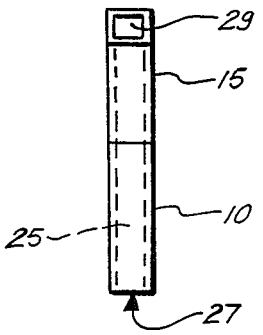
FIG. 10 is a side view, partly in phantom, of a device of this invention having a hollow interior.
Figure 11:
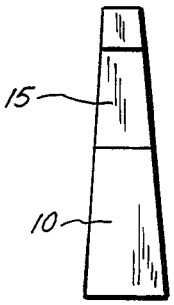
FIGS. 11 through 13 are side views of devices of this invention, and serve to illustrate some of the various configurations in which they may be provided.
Figure 12:
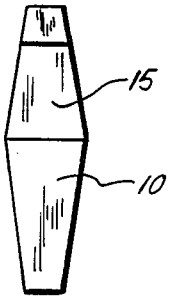
Figure 13:
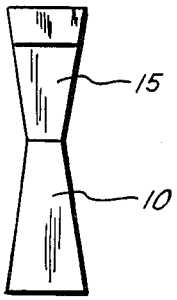

FIGS. 9 and 10 depict still another particularly preferred embodiment of this invention, namely the provision of devices with hollow interiors. In this embodiment at least the trunk portion 10 is hollow to provide an interior passageway 25 to accommodate an upward interior flow of air entering the trunk portion at one or more entry ports 27 disposed in a lower portion of the trunk and leaving the trunk portion at an upper portion thereof such as (i) through one or more vents (not shown) in the upper surface of trough 14 (which trough of course may have any suitable shape including those depicted for example in FIGS. 4, 5 or 7, or (ii) through vents 29,29 disposed at the ends of arms 15,15. Most preferably the trunk portion and each of the arms are hollow to accommodate the upward interior flow of air entering the trunk portion and leaving from the respective arms.

Figure 2:
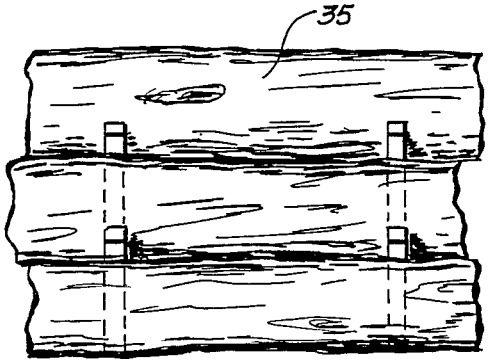
FIG. 2 is a side view, partly in phantom, of a stack of six logs spaced apart pursuant to this invention.

FIGS. 1 and 14 show stacks of six and of three logs 35, respectively, spaced apart by means of spacers of this invention. The use of pairs of spacers, one in proximity to each end of the log, to keep a stack of logs 35 in spaced-apart relationship is depicted in FIG. 2. In some cases only one spacer positioned as in FIG. 14 will provide sufficient spacing to achieve improved combustion initiation.

The spacers are preferably fabricated as a single unitary member, but may be formed by uniting separate parts. The spacers may be fabricated from fireproof materials such as iron, aluminum, or other metals, and porcelain, fired clay or other ceramic materials. In another form the devices are composed of wood suitably impregnated with a fire retardant or a plastic or polymeric material that has been suitably treated or filled with a fire retardant such as ammonium polyphosphate, borax or the like to delay the onset of combustion of the device until after it has served its purpose of keeping the logs separated from each other until they have commenced burning to a sufficient extent that spacing is no longer needed. Plastic foams of suitable materials that are only slowly consumed by the flames such as foamed polyimide may also be used.

The dimensions of the devices of this invention can be varied to suit the needs of the occasion. Generally speaking the arms 15,15 and trunk portions will have a thickness sufficient to separate the logs by, say, 0.5 to 1 inch. The length of the arms and the trunk may likewise be varied depending upon the size of the logs with which the devices are to be used, and thus may range from 2 or 3 inches up to a foot or more.

It should now be clear that to improve the initiation of combustion of logs pursuant to this invention spacers are interposed between the respective logs to space them apart from each other. Thereupon the logs are subjected to a source of ignition sufficient to initiate combustion of the logs during the time they are spaced apart from each other.

While the devices of this invention have been discussed with reference to their use in maintaining the logs of stacks of fireplace logs in spaced-apart relationship, such devices may also be used for other purposes, such as for maintaining in spaced-apart stacked relationship during storage elongate objects such as fence posts, lumber, water pipes, and the like. The use of such spacers for this purpose facilitates gripping and removal of the items stacked in this manner.

This invention is susceptible to considerable variation in its practice, the forms hereinbefore discussed being but preferred exemplifications thereof. Thus it is not intended that this invention be limited by this disclosure. Rather, this invention is intended to embrace the subject matter within the spirit and scope of the appended claims and the equivalents thereof.

I claim:

1. In combination, a stack composed of a plurality of individual horizontally-positioned fireplace logs and a plurality of spacers interposed between the individual logs to maintain space therebetween, said spacers being characterized in that (a) the spacers have in vertical cross-section a generally Y-shaped configuration whereby the spacer comprises (i) a trunk portion adapted to be interposed in an upright position between two laterally adjacent logs to provide spacing therebetween, and (ii) a pair of upwardly and outwardly extending arms forming an upper surface for supporting another such log above, between and spaced from said two laterally adjacent logs; and (b) the upwardly facing surface between said arms is a concave surface and each of the pair of downwardly and outwardly facing surfaces defined respectively (i) by the lower portion of one arm and the proximate side of said trunk portion proximate thereto and (ii) by the lower portion of the other arm and the proximate side of said trunk portion proximate thereto, is a concave surface whereby the structural strength of said spacer is enhanced about its center, and each of said surfaces is adapted to accommodate the curvature of the log immediately adjacent thereto.

2. A combination of claim 1 wherein said spacers are fabricated from fireproof material.

3. A combination of claim 1 wherein said spacers are fabricated from a combustible, but fire-resistant material.

4. A combination of claim 1 wherein said trunk portion and each of said arms are of substantially equal length and are disposed relative to each other such that their respective longitudinal axes radiate from the center of the Y-shaped configuration at essentially 120 degree angles.

5. A combination of claim 4 wherein said trunk portion and each of said arms have essentially the same configuration so that said Y-shaped configuration is substantially symmetrical in all radial directions around said center.

6. A combination of claim 1 wherein the lower end of said trunk portion has a lateral extension on each side adapted to fit under a portion of the log immediately adjacent thereto.

7. A combination of claim 1 wherein at least the trunk portion of the spacers is hollow to accommodate an upward interior flow of air entering the trunk portion at a lower portion thereof and leaving the trunk portion at an upper portion thereof.

8. A combination of claim 1 wherein the trunk portion and each of the arms of the spacers are hollow to accommodate an upward interior flow of air entering the trunk portion and leaving from the respective arms.

9. A method of improving the initiation of combustion of logs which comprises interposing spacers between the respective logs to space them apart from each other, and subjecting the logs to a source of ignition sufficient to initiate combustion of the logs during the time they are spaced apart from each other, said spacers being characterized in that (a) the spacers have in vertical cross-section a generally Y-shaped configuration whereby the spacer comprises (i) a trunk portion adapted to be interposed in an upright position between two laterally adjacent logs to provide spacing therebetween, and (ii) a pair of upwardly and outwardly extending arms forming an upper surface for supporting another such log above, between and spaced from said two laterally adjacent logs; and (b) the upwardly facing surface between said arms is a concave surface and each of the pair of downwardly and outwardly facing surfaces defined respectively (i) by the lower portion of one arm and the proximate side of said trunk portion proximate thereto, and (ii) by the lower portion of the other arm and the proximate side of said trunk portion proximate thereto, is a concave surface whereby the structural strength of said spacer is enhanced about its center, and each of said surfaces is adapted to accommodate the curvature of the log immediately adjacent thereto.

10. A method of claim 9 wherein said spacers are fabricated from fireproof material.

11. A method of claim 9 wherein said spacers are fabricated from a combustible material that last long enough in the flames to maintain the logs in spaced-apart relationship at least until they have become sufficiently ignited to burn without being spaced apart from each other.

12. A device for maintaining a space between adjacently-positioned linear objects which comprises a member having in vertical cross-section a generally Y-shaped configuration whereby the member comprises (i) a trunk portion adapted to be interposed in an upright position between two laterally adjacent said objects to provide spacing therebetween, and (ii) a pair of upwardly and outwardly extending arms forming an upper surface for supporting another such object above, between and spaced from said two laterally adjacent objects, the member being further characterized in that the upwardly facing surface between said arms is a concave surface and each of the pair of downwardly and outwardly facing surfaces defined respectively (a) by the lower portion of one arm and the proximate side of said trunk portion proximate thereto and (b) by the lower portion of the other arm and the proximate side of said trunk portion proximate thereto, is a concave surface whereby the structural strength of said device is enhanced about its center, and each of said surfaces is adapted to accommodate the exterior of an object when positioned immediately adjacent thereto.

13. A device of claim 12 fabricated from fireproof material.

14. A device of claim 12 fabricated from a combustible, but fire-resistant material.

15. A device of claim 12 wherein said trunk portion and each of said arms are of substantially equal length and are disposed relative to each other such that their respective longitudinal axes radiate from the center of the Y-shaped configuration at essentially 120 degree angles.

16. A device of claim 15 wherein said trunk portion and each of said arms have essentially the same configuration so that said Y-shaped configuration is substantially symmetrical in all radial directions around said center.

17. A device of claim 12 wherein the lower end of said trunk portion has a lateral extension on each side adapted to fit under a portion of an object when positioned immediately adjacent thereto.

18. A device of claim 12 wherein at least the trunk portion if hollow to accommodate an upward interior flow of air entering the trunk portion at a lower portion thereof and leaving the trunk portion at an upper portion thereof.

19. A device of claim 12 wherein the trunk portion and each of the arms are hollow to accommodate an upward interior flow of air entering the trunk portion and leaving from the respective arms.

20. A device of claim 12 wherein (i) said trunk portion and each of said arms are of substantially equal length and are disposed relative to each other such that their respective longitudinal axes radiate from the center of the Y-shaped configuration at essentially 120 degree angles, and (ii) said trunk portion and each of said arms have essentially the same configuration so that each Y-shaped configuration is substantially symmetrical in all radial directions around said center.

* * * * *